US012458855B2

(12) United States Patent
Greba et al.

(10) Patent No.: US 12,458,855 B2
(45) Date of Patent: Nov. 4, 2025

(54) CORNHOLE BOARD WITH LOAD-DISTRIBUTION INTERSECTING BRACES

(71) Applicant: West Georgia Cornhole LLC, Villa Rica, GA (US)

(72) Inventors: Brandon Leigh Greba, Villa Rica, GA (US); Benjamin Horton, Temple, GA (US)

(73) Assignee: West Georgia Cornhole LLC, Villa Rica, GA (US)

( * ) Notice: Subject to any disclaimer, the term of this patent is extended or adjusted under 35 U.S.C. 154(b) by 831 days.

(21) Appl. No.: 17/699,928

(22) Filed: Mar. 21, 2022

(65) Prior Publication Data

US 2022/0296977 A1 Sep. 22, 2022

Related U.S. Application Data

(60) Provisional application No. 63/164,225, filed on Mar. 22, 2021.

(51) Int. Cl.
*A63B 67/06* (2006.01)

(52) U.S. Cl.
CPC ..... *A63B 67/06* (2013.01)

(58) Field of Classification Search
CPC ..... A63B 67/06
See application file for complete search history.

(56) References Cited

PUBLICATIONS https://fluxcornhole.com/capacitor-custom-cornhole-boards.html (Year: 2022).*
"Flux Capacitor Cornhole Boards—Custom", https://fluxcornhole.com/capacitor-custom-cornhole-boards.html, printed out on Mar. 10, 2022, 3 pages.
Tailgating Pros, "4'x2' Lightweight Regulation Cornhole Boards—Tailgating Pros", printed out on Mar. 9, 2022, 3 pages.

* cited by examiner

*Primary Examiner* — Jeffrey S Vanderveen
(74) *Attorney, Agent, or Firm* — Perilla Knox & Hildebrandt LLP

(57) ABSTRACT

A frame, two support legs extending downward from a first end portion of the frame, a top panel supported by the frame and including an opening through which toss bags can be received, and an intersecting bracing system adjacent a bottom surface of the top panel. The intersecting bracing system is configured to prevent flexing and bowing of the top panel when the top panel is impacted with the tossed bags during game play and also to absorb and distribute the impact forces of the tossed bags striking the top panel during game play.

23 Claims, 5 Drawing Sheets

CORNHOLE BOARD WITH LOAD-DISTRIBUTION INTERSECTING BRACES

CROSS-REFERENCE TO RELATED APPLICATION

This application claims the priority benefit of U.S. Provisional Patent Application Ser. No. 63/164,225, filed Mar. 22, 2021, which is hereby incorporated by reference herein for all purposes.

TECHNICAL FIELD

The present invention relates generally to toss games, and particularly to boards for playing the toss game of cornhole.

BACKGROUND

Cornhole games provide fun and entertainment for many people, and have become so popular that there are now professional leagues. Conventional cornhole game sets include two cornhole boards and two sets of toss bags (e.g., bean-filled bags). While these game sets provide the basic functionality needed for playing cornhole games, traditional designs of the boards have several deficiencies. For example, conventional boards have a center brace across the back that does not adequately dissipate the striking force of a cornhole toss bag, with the result that the boards flex and bow slightly. This flexing and bowing of the boards tends to result in the bags bouncing on, and sometimes off of, the boards. And if the boards are too rigid and inflexible, then the striking force of the tossed bags tends to result in the boards displacing slightly, that is, skipping or scooting backwards across the ground (aka "walking").

Accordingly, it can be seen that needs exist for improvements in cornhole boards. It is to the provision of such a solution that the present invention is primarily directed.

SUMMARY

Generally described, the present invention relates to a cornhole board having a frame, two support legs extending downward from a first end portion of the frame, a top panel supported by the frame and including an opening through which toss bags can be received, and an intersecting bracing system adjacent a bottom surface of the top panel. The intersecting bracing system is configured to prevent flexing and bowing of the top panel when the top panel is impacted with the tossed bags during game play and to absorb and distribute the impact forces of the tossed bags striking the top panel during game play.

In typical embodiments, the intersecting bracing system is a cross-brace system including at least two elongated braces arranged in the shape of an X and positioned with the opening between two V-shaped brace segments of the bracing system. The braces each extend to end portions of the top panel, for example to adjacent frame end members. The braces can each be laterally offset from frame side members to allow clearance for the legs without creating interference with the opening in the top panel. In embodiments in which the legs have a cross brace, the braces each have a recess configured to align with and receive the leg cross brace when the legs are in a stored position. In other embodiments, the intersecting bracing system is another type of intersecting brace system (e.g., a chevron, Y-shaped, or other cross brace system) that includes at least two intersecting braces with the opening between them.

The specific techniques and structures employed to improve over the drawbacks of the prior art and accomplish the advantages described herein will become apparent from the following detailed description of example embodiments and the appended drawings and claims.

DETAILED DESCRIPTION OF EXAMPLE EMBODIMENTS

Generally described, the present invention relates to an improved game board for playing cornhole games with toss bags. The cornhole boards can be of the type used for tailgating, for playing in the back yard, and/or by professional televised cornhole players. While the cornhole boards described herein are for use in playing current cornhole games, persons of ordinary skill in the art will appreciate that the boards can be readily adapted for use in playing past and/or new variations of conventional cornhole and other toss games, and such adapted board versions are contemplated by and within the scope of the invention.

FIGS. 1-6 show a cornhole board 10 according to a first example embodiment of the invention. The board 10 can be used with toss bags to play conventional cornhole games.

Figure 1:
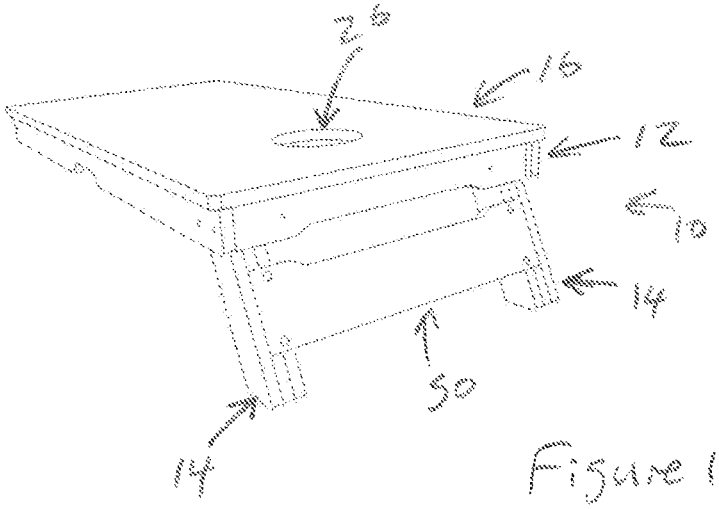
FIG. 1 is a top perspective view of a cornhole board according to a first example embodiment of the invention.
Figure 2:
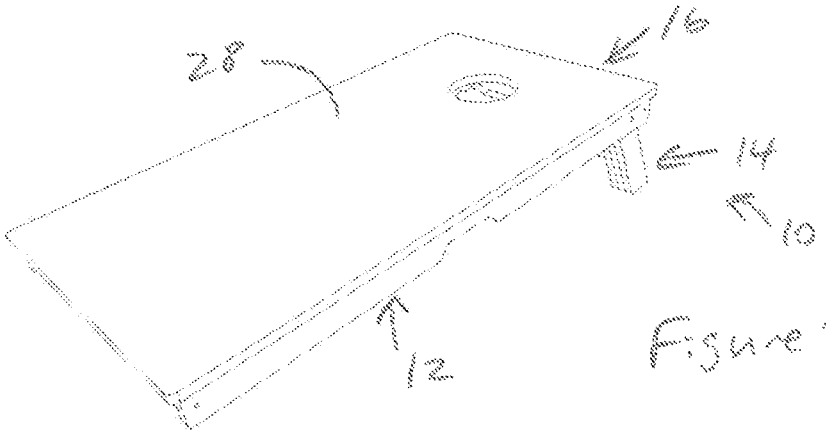
FIG. 2 is another top perspective view of the cornhole board of FIG. 1.
Figure 3:
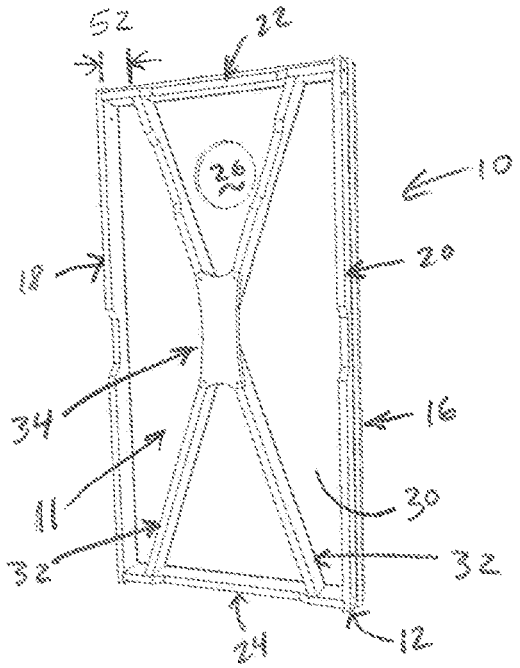
FIG. 3 is a bottom perspective view of the cornhole board of FIG. 1 shown without the support legs.
Figure 4:
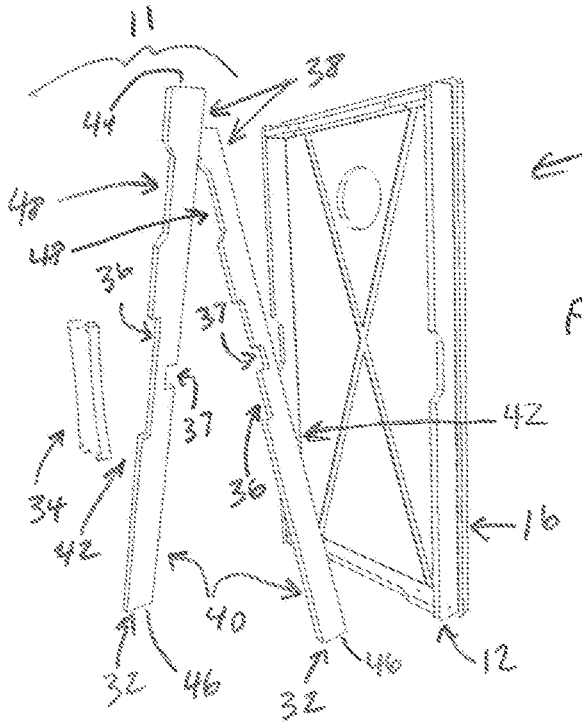
FIG. 4 is an exploded view of the cornhole board of FIG. 3.
Figure 5:
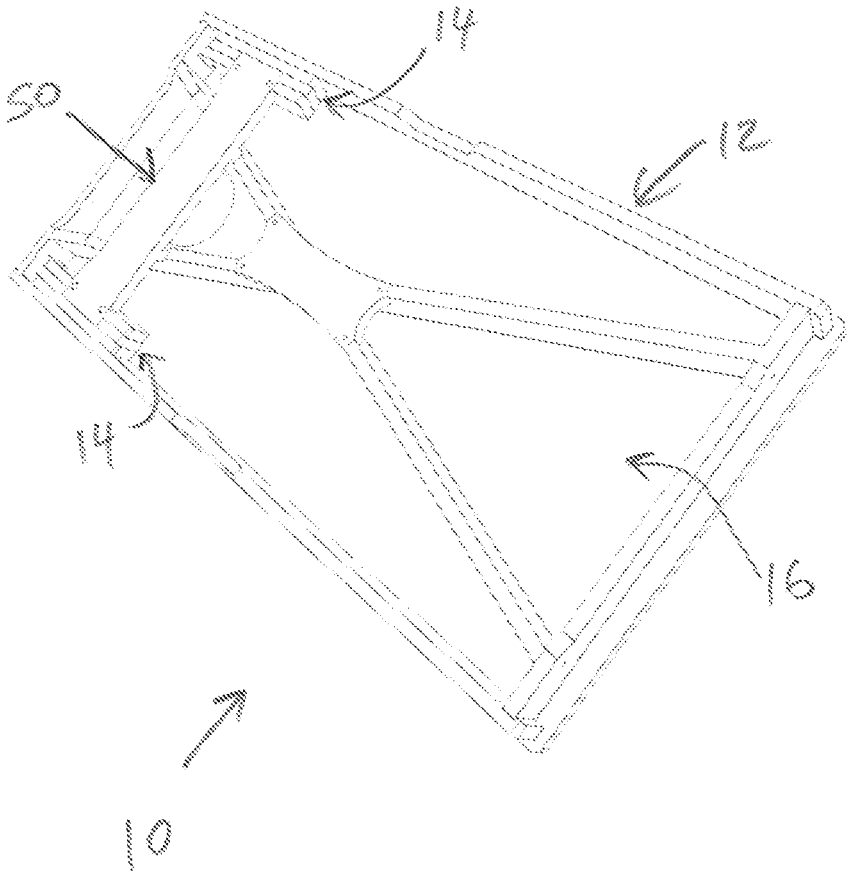
FIG. 5 is another bottom perspective view of the cornhole board of FIG. 1.
Figure 6:
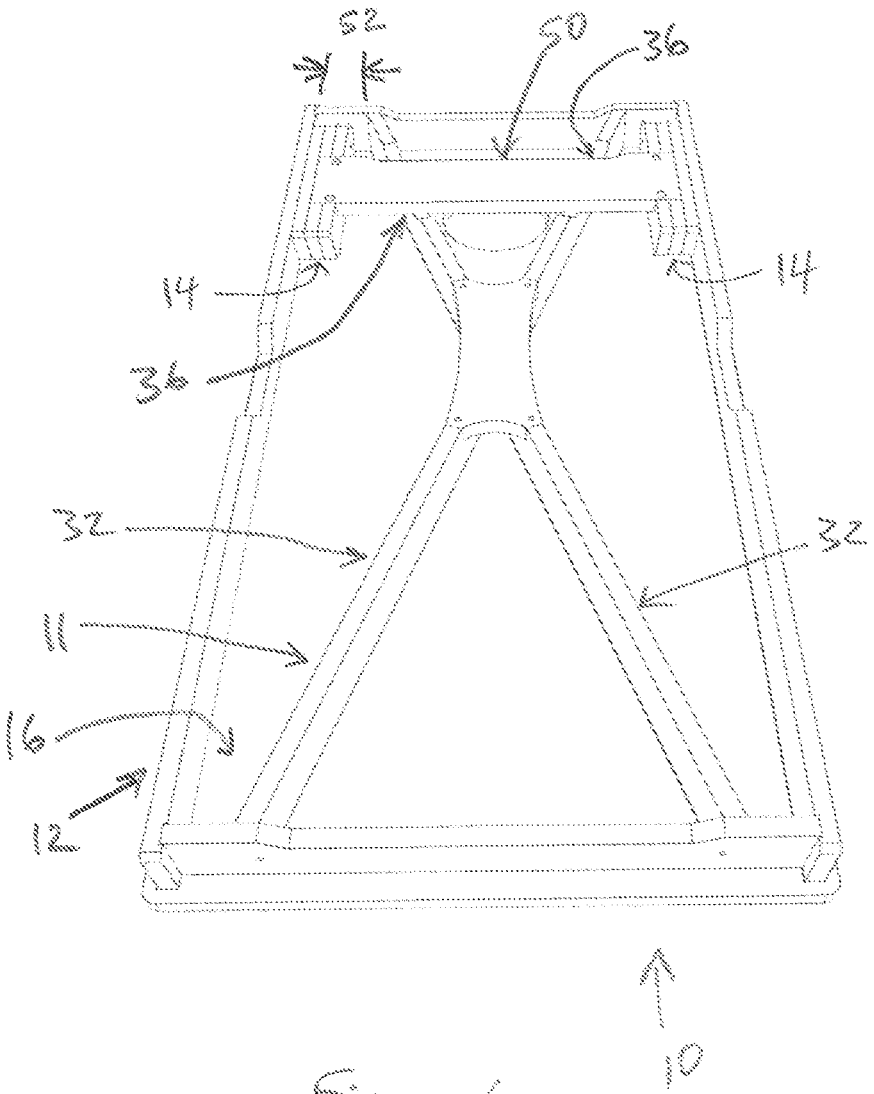
FIG. 6 is another bottom perspective view of the cornhole board of FIG. 1.

The board 10 includes a peripheral frame 12, two support legs 14 mounted to the frame 12, and a top panel 16 supported by the frame 12. The frame 12 is typically rectangular, with first and second opposing side frame members 18 and 20 and first and second opposing end frame members 22 and 24 that peripherally support the top panel 16. The legs 16 extend downward from a first end portion of the frame 12 that is elevated during playing use of the board 10, with the second/opposite end portion of the frame 12 supported by a ground support surface (grass/earth, pavement, flooring, or another support surface), so that the top panel 16 is angled relative to horizontal ground. Also, the legs 14 are typically pivotally mounted to the frame 12, for example to the side frame members 18 and 20, so that they pivot between a use position (FIGS. 1-2) and a storage/transport position (FIGS. 5-6). The top panel 16 is typically rectangular (the same size or slightly larger than the frame 12) and includes an opening 26 (e.g., a circular hole) that is configured (i.e., sized and shaped) so that the toss bags can be received through it during game play. The opening 26 is typically laterally centered in the top panel 16 but longitudinally off-center toward the first elevated end portion. Also, the top panel 16 has a top surface 28 upon which the toss bags can slide, and a bottom surface 30 opposite the top surface. In typical embodiments, the frame 12 and top panel 16 are about 4 feet long by about 2 feet across, the legs 14 are about 1 foot long, the frame 12 is about 3-4 inches in thickness/height, and the opening 26 is about 6 inches in diameter, though these components can be provided in other sizes (and shapes) as may be desired.

These components of the board 10 can be of a conventional design and construction, and can be made of conventional materials (e.g., wood). In other embodiments, these components can have other configurations, such as a different shaped frame, a frame that is encasing or flush (instead of inset, as depicted) with the edges of the top panel, legs integrally formed into the frame as one piece, and/or other variations as may be known in the art.

In addition, the board 10 includes an intersecting bracing system 11 that distributes and dissipates the striking force of a tossed bag impacting the top panel 16 of the board 10. In this way, the intersecting bracing system 11 reinforces and substantially prevents flexing and bowing (resilient deformation/deflection) of the top panel 16 of the board 10, and the resulting bouncing of the toss bags, when the board 10 is impacted by the tossed bags during game play. At the same time, the bracing system 11 distributes and dissipates (absorbs) the striking forces to substantially prevent walking/displacement of the board 10 when the top panel 16 is impacted by the tossed bags during game play. As used herein, this means that the bracing system 11 prevents such flexing and bowing, and such bouncing and walking, of the boards 10 to the point of not being noticeable to the game players and having no (or only negligible) impact on the game play.

To accomplish this, the intersecting bracing system 11 includes at least two elongated braces having two segments that intersect in the shape of a "V," are positioned at the bottom surface of the top panel 16, and have the opening between them. In typical embodiments, the intersecting bracing system 11 further includes one or more additional elongated brace segments extending from the apex (intersection) of the V-shaped brace segments and positioned at the bottom surface of the top panel 16. The two non-intersecting ends of the V-shaped elongated brace segments typically extend to the first frame end member 22 of the peripheral frame 12 and the one or more additional elongated brace segments typically extend to the second opposite frame end member 24 (and/or to the first and/or second opposite frame side members 18 and 20) of the peripheral frame 12.

In the depicted embodiment, for example, the intersecting bracing system 11 includes at least two elongated brace members 32 that intersect and are arranged in the shape of an "X" (i.e., two apex-to-apex V-braces, with the opening 26 between the brace segments of one of the V-braces). The brace members 32 are positioned adjacent to the bottom surface 30 of the top panel 16 and extend along the length of the top penal 16. The brace members 32 contact the top panel 16 and each other (always or at least when the top panel 16 is impacted by a tossed bag) so that the striking forces (from the impacting toss bag) are transmitted from the top panels 16 to the brace members 32 and then along their lengths to distribute and dissipate the striking forces (between the two braces 32 and along their lengths). The brace members 32 are typically attached to the bottom surface 30 of the top panel 16 (e.g., by gluing and screwing), but alternatively or additionally can be attached to the frame 12. The brace members 32 are made of a material (e.g., wood) and have a size (width, thickness/height, and length) selected to provide bracing strength and rigidity to the top panel 16 so that it does not deflect upon impacts of the tossed bags and selected to distribute/dissipate those resulting striking forces, as described herein.

In the depicted embodiment, the X-shaped bracing system 11 further includes a coupling 34 that connects the two braces 32 together (FIGS. 3-6). For example, the coupling 34 can be nested/received in cooperating recesses 36 in the bottom surfaces of the two braces 32. Such a coupling 34 can be in the form of a rigid plate (e.g., made of steel) that is elongated (in the same direction as the board 10) and mounts (e.g., by screws or other fasteners) at two places to each brace 32, with the intersection point of the two braces 32 centered between them. In this way, the coupling 34 provides a four-point attachment to the braces 32 for strength in retaining the braces 32 in the X shape and for distributing the striking forces between the braces 32. The depicted X-shaped bracing system 11 includes two continuous (one-piece) braces 32 connected together by the coupling 34 to form the X shape for bracing the top panel 16 against resilient deflection and for distributing the striking forces, though other embodiments can include three or four brace members arranged in an X shape and connected together by a coupling. In other embodiments, other conventional couplings can be used, or the braces can be attached to the top panel and/or directly to each other without using a coupling at their intersection.

Additionally or alternatively, the braces 32 are typically directly interconnected together where the intersect. For example, the depicted braces 32 have oppositely arranged slots 37 that receive each other, with one of the slots in the top surface of one brace and with the other slot in the bottom surface of the other brace (and thus in communication with the respective recess 36). In this way, the braces 32 interlock and form a flush joint (relative to each other). The depicted X-shaped bracing system 11 includes two continuous (one-piece) braces 32 directly interconnected together by the slots 37 to form the X shape for bracing the top panel 16 against resilient deflection and for distributing the striking forces, though other embodiments can include three or four brace members arranged in an X shape and connected together by a coupling. In other embodiments, other conventional direct interlocking connections can be used, or the braces can be attached to the top panel and/or indirectly to each other with a coupling at their intersection without being directly interlocked together.

In addition, the two braces 32 each have a first end portion 38, an opposite second end portion 40, and a center portion between them 42 (FIGS. 3-6). The first end portions 38 extend to a respective first end portion (e.g., ¼) of the top panel 16, the second end portions 40 extend to a respective opposite second end portion (e.g., ¼) of the top panel 16, and the center portions 42 intersect in a center portion (e.g., middle ½) of the top panel 16 between the end portions 38 and 40. In typical embodiments, first end edges 44 of the braces 32 extend to adjacent (contacting or close to) the end frame member 22 and second end edges 46 of the braces 32 extend to adjacent (contacting or close to) the other end frame member 24, so that the braces 32 extend along all, or substantially all, of the length of the top panel 16. For example, the end edges 44 and 46 of the braces 32 can contact the end frame members 22 and 24, as depicted. In other embodiments, the end edges of the braces stop short of the end frame members, but are still in the end (¼) portions of the top panel. For example, in some embodiments the first end edges of the braces extend to adjacent the first frame end member (for strengthening and load distributing close to the hole 26 in the top panel 16) but the second end edges of the braces do not extend to the second frame end members (but are still in the second end (¼) portion of the top panel). In this way, the braces 32 each extend continuously (as one piece) along a substantial portion (at least ½) of the length of the top panel 16 to provide increased strength and load distribution to the top panel 16.

Furthermore, the first end portions 38 of the braces 32 can each be positioned laterally inward and spaced apart from the frame side members 18 and 20, with the legs 14 positioned between the braces 32 and the frame 12. That is, the braces 32 can be positioned extending to locations laterally inward from the corners, instead of into the four corners of the frame 12 and panel 16. So the brace end portions 38 are each positioned at an offset 52 from the respective frame side member 18 or 20, with the offset (spacing/distance) being greater than the width of the respective leg 14. For example, the legs 14 each typically have a width of about 1-2 inches, so the offset 52 is typically at least about 1-2 inches on each side. In the depicted embodiment, the top panel 16 extends outwardly slightly beyond frame 12, so the first end portions 38 of the braces 32 are positioned laterally inward from the outside surface of the frame side members 18 and 20 by greater than the combined widths of the respective leg 14 and frame side member 18 or 20, and are positioned laterally inward by even greater than that from the side edge of the top panel 16. This offset 52 enables the desired X-brace functionality described herein while avoiding mechanical interference with the legs 14 in the use or stored positions.

Also, the braces 32 can each be positioned on the top panel 16 so that they (two V-shaped brace segments) do not interfere with the opening 26 (or the toss bags that pass through the openings 26 during game play). For example, the braces 32 are typically positioned on the panel 16 to provide at least 0.5 inch of clearance/spacing from the edge of the opening 26, with a clearance/spacing of about 0.05 or 1.0 inch to about 2.0 or 3.0 inches working well. This places the braces 32 so they are free of interference with the opening 26 (and toss bags that fall through it) but yet still proximate to the opening 26 to provide bracing strength for the top panel 16 where it is relatively weaker (due to the absence of material forming the opening 26).

At the same time, the braces 32 are laterally spaced from the frame 12, as described above. Thus, the braces 32 typically have a lateral dimension (width) selected to provide sufficient spacing from the frame 12 on one side and from the opening 26 on the other side. The braces 26 also typically have a thickness (height) that is no more than the thickness (height) of the frame 12 so that the braces are flush with or inset from the frame 12. Typically, the two brace members 32 are arranged in an X-shape that is symmetrical, for example as depicted, though in other embodiments the brace members are laterally inset from the frame at the first/upper end for clearance for the legs and they extend to the corners of the panel and/or frame at the second/lower end while still maintaining clearance from the opening.

In the depicted embodiment, the first end portions 38 of the braces 32 each have a recess 48 configured (positioned, sized, and shaped) so that the recesses 48 align with each other. A leg cross brace 50 extends between the two legs 14, and when the legs 14 are pivoted to against the bottom surface of the top panel 16 in a compact position for storage and/or transport, the aligned recesses 48 receive the leg cross brace 50 (FIGS. 3-6). For example, the cross-brace recesses 48 can each be trapezoidal (or another polygonal shape), align laterally with each other, and/or be otherwise configured to receive the leg cross brace 50 so that the legs 14 and the leg cross brace 50 do not extend below the lower surface of the frame 14 when in the storage/transport position. This provides increased rigidity and strength, but avoids mechanical interference with the leg cross brace 50. In some embodiments, each brace has two of the recesses in a symmetrical arrangement so that the braces can be installed on the panel without having to orient it with the recess at the end portion with the legs. In other embodiments, the legs do not have a cross brace and so the panel braces do not have the recesses for receiving them.

Accordingly, the board 10 with the intersecting bracing system 11 is stronger and more rigid than other braced cornhole boards, without adding more thickness and material to the top panel 16 and/or frame 12. As such, the toss bags do not bounce on the top panel 16 upon impacting the board 10. At the same time, the board 10 with the intersecting bracing system 11 distributes and dissipates the striking forces of tossed bags better than other braced cornhole boards. As such, the board 10 does not move/walk upon impacts of the toss bags striking the board 10. Also, the inclusion of the intersecting bracing system 11 strengthens the overall structural integrity of the board 10. Further, the inclusion of the intersecting bracing system 11 improves the acoustic qualities of the board 10, because vibrations and sound waves from the bag impacts travel through/along the elongated braces 32 to the edges of the boards 10 rather than amplifying the sound on the top of the boards like other cornhole boards.

Figure 7:
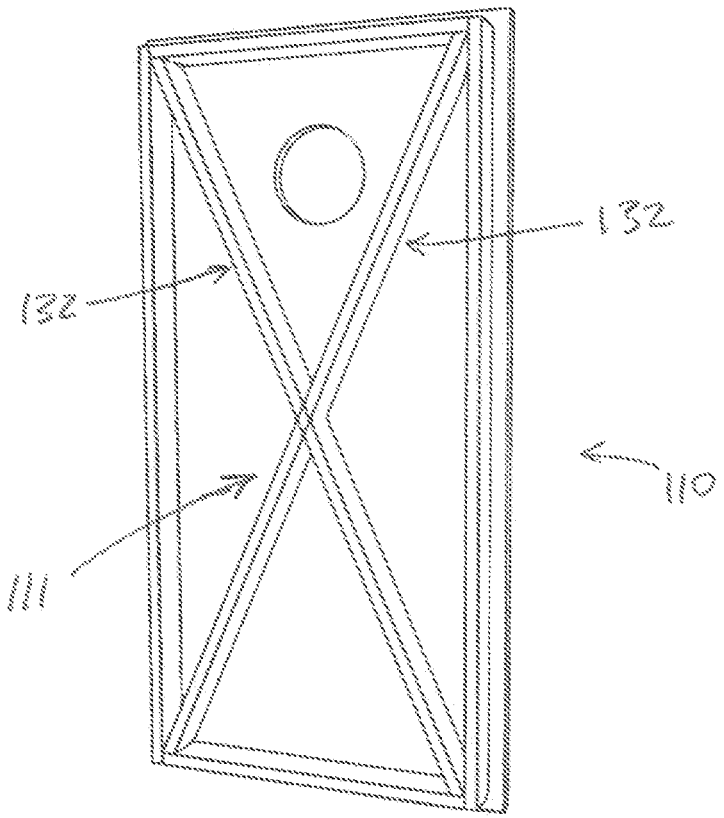
FIG. 7 is a bottom perspective view of a cornhole board according to a second example embodiment of the invention, shown without the support legs.

In another example embodiment shown in FIG. 7, the board 110 includes an intersecting bracing system 111 having at least two brace members 132 that intersect and are arranged in the shape of an "X," with the braces 132 extending to the four corners of the board 110 (with no lateral offset as in the first embodiment). This X-brace system can be used in embodiments without legs or with legs attached at the outside of the frame. And in other embodiments, the board includes an intersecting bracing system having any type of bracing on the underside of the top panel in the shape of an "X," whether it is arched, a single bonded structure, or a convex X-shaped bracing system.

As such, board embodiments within the scope of the invention include an intersecting bracing system including two intersecting elongated brace segments in the shape of a "V," with the opening positioned between the V-shaped brace segments, and with or without one or more additional elongated brace segments extending from the apex/intersection of the V-shaped brace segments. In the depicted embodiment, two additional elongated brace segments intersect (in the shape of an "V") so that combined the two sets of V-shaped brace segments are arranged apex-to-apex to form the shape of an "X." In other embodiments, the one or more additional elongated brace segments extending from the apex/intersection are longitudinally arranged, laterally arranged, or both. In other embodiments, no additional brace segments extend from the apex, which can be positioned at the second end frame member. These embodiments can be provided with any of the features described above for the X-shaped bracing system.

It is to be understood that this invention is not limited to the specific devices, methods, conditions, and/or parameters described and/or shown herein, and that the terminology used herein is for the purpose of describing particular embodiments by way of example only. Thus, the terminology is intended to be broadly construed and is not intended to be unnecessarily limiting of the claimed invention. For example, as used in the specification including the appended claims, the singular forms "a," "an," and "one" include the plural, the term "or" means "and/or," and reference to a particular numerical value includes at least that particular value, unless the context clearly dictates otherwise. In addition, any methods described herein are not intended to be limited to the sequence of steps described but can be carried out in other sequences, unless expressly stated otherwise herein.

While the invention has been shown and described in exemplary forms, it will be apparent to those skilled in the art that many modifications, additions, and deletions can be made therein without departing from the spirit and scope of the invention as defined by the following claims.

What is claimed is:

1. A cornhole board for use with toss bags to play cornhole games, comprising:

a peripheral frame;

a top panel supported by the peripheral frame, wherein the top panel includes an opening through which the toss bags can be received, a top surface upon which the toss bags can slide during game play, and a bottom surface opposite the top surface;

two support legs extending downward from a first end portion of the frame, wherein the legs elevate the first end portion of the frame to orient the top panel at an angle; and an X-shaped bracing system adjacent to the bottom surface of the top panel, wherein the X-shaped bracing system reinforces and prevents flexing and bowing of the top panel when the top panel is impacted with the tossed bags during game play, wherein the X-shaped bracing system distributes and dissipates impact forces from the tossed bags during game play, wherein the X-shaped bracing system includes two braces arranged in the shape of an X, wherein the two braces each have a first end portion, an opposite second end portion, and a center portion therebetween, and wherein the first end portions extend to a respective first end portion of the top panel, the second end portions extend in a respective opposite second end portion of the top panel, and the center portions intersect in a center portion of the top panel between the top panel end portions.

2. The cornhole board of claim 1, wherein the first end portions of the braces extend to adjacent a respective first end member of the peripheral frame, the second end portions of the braces extend to adjacent a respective second opposite end member of the peripheral frame, or both.

3. The cornhole board of claim 1, wherein the first end portions of the braces are each positioned laterally inward and spaced apart from the frame by a respective offset, wherein the legs are positioned in the offset between the first end portions of the braces and the frame.

4. The cornhole board of claim 1, wherein the first end portions of the braces are each positioned proximate to but not interfering with the opening in the top panel, wherein the braces are positioned to provide spacing from the frame on one side sufficient to avoid interference with the legs and spacing from the opening on the other side to avoid interference with the toss bags passing through the opening during game play.

5. The cornhole board of claim 1, wherein the first end portions of the braces each have a recess configured so that the recesses each align with and receive a leg cross brace extending between the two legs when the legs are pivoted against the top panel bottom surface in a compact position for transport.

6. The cornhole board of claim 1, wherein the braces are continuous along their entire lengths from their first end portions to their second end portions.

7. The cornhole board of claim 6, wherein the braces are connected together at their center portions.

8. The cornhole board of claim 7, wherein the braces are connected together by an interlocking connection at the intersection of their center portions.

9. The cornhole board of claim 8, wherein the interlocking connection includes mating slots in the braces.

10. The cornhole board of claim 1, wherein the X-shaped bracing system includes a coupling that connects the two braces together at their center portions.

11. The cornhole board of claim 10, wherein the coupling is nested in cooperating recesses of the two braces.

12. A cornhole board for use with toss bags to play cornhole games, comprising:

a peripheral rectangular frame including opposing first and second opposing side members and first and second opposing end members;

a rectangular top panel supported by the peripheral frame, wherein the top panel includes an opening through which the toss bags can be received, a top surface upon which the toss bags can slide during game play, and a bottom surface opposite the top surface;

two support legs extending downward from a first end portion of the frame, wherein the legs are pivotally mounted to the frame for repositioning between a use position angled from the top panel and a storage position against the top panel, wherein the legs elevate the first end portion of the frame to orient the top panel at an angle in the use position; and an X-shaped bracing system adjacent to the bottom surface of the top panel, wherein the X-shaped bracing system includes two braces arranged in the shape of an X, wherein the two braces each have a first end portion, an opposite second end portion, and a center portion therebetween, wherein the first end portions extend to a respective first end portion of the top panel, the second end portions extend in a respective opposite second end portion of the top panel, and the center portions intersect in a center portion of the top panel between the top panel end portions, wherein the braces are continuous along their entire lengths from their first end portions to their second end portions, wherein the braces are connected together by an interlocking connection at the intersection of their center portions, wherein the first end portions of the braces are each positioned laterally inward and spaced apart from the side members of the frame by a respective offset, wherein the legs are positioned in the offset between the first end portions of the braces and the side members of the frame, wherein the braces reinforce and prevent flexing and bowing of the top panel when the top panel is impacted with the tossed bags during game play, and wherein the braces distribute and dissipate impact forces from the tossed bags during game play.

13. The cornhole board of claim 12, wherein the first end portions of the braces extend to adjacent a respective first end member of the peripheral frame, the second end portions of the braces extend to adjacent a respective second opposite end member of the peripheral frame, or both.

14. The cornhole board of claim 12, wherein the first end portions of the braces are each positioned proximate to but not interfering with the opening in the top panel, wherein the braces are configured to provide spacing from the frame on one side sufficient to avoid interference with the legs and spacing from the opening on the other side to avoid interference with the toss bags passing through the opening during game play.

15. The cornhole board of claim 12, wherein the first end portions of the braces each have a recess configured so that the recesses each align with and receive a leg cross brace extending between the two legs when the legs are pivoted against the top panel bottom surface in a compact position for transport.

16. The cornhole board of claim 12, wherein the X-shaped bracing system includes a coupling that connects the two braces together at their center portions.

17. The cornhole board of claim 16, wherein the two braces are attached to the bottom surface of the top panel.

18. The cornhole board of claim 12, wherein the interlocking connection includes mating slots in the braces.

19. A cornhole board for use with toss bags to play cornhole games, comprising:

a peripheral frame;

a top panel supported by the peripheral frame, wherein the top panel includes an opening through which the toss bags can be received, a top surface upon which the toss bags can slide during game play, and a bottom surface opposite the top surface;

two support legs extending downward from a first end portion of the frame, wherein the legs elevate the first end portion of the frame to orient the top panel at an angle; and an intersecting bracing system adjacent to the bottom surface of the top panel, wherein the intersecting bracing system reinforces and prevents flexing and bowing of the top panel when the top panel is impacted with the tossed bags during game play, wherein the intersecting bracing system distributes and dissipates impact forces from the tossed bags during game play, wherein the intersecting bracing system includes at least two elongated braces intersecting in the shape of a V and positioned at the bottom surface of the top panel with the opening between them, wherein the intersecting bracing system further includes one or more additional elongated braces extending from an apex of the V-shaped braces, and wherein the two V-shaped elongated braces extend to a first end frame member of the peripheral frame and the one or more additional elongated braces extend to a second opposite end frame member of the peripheral frame.

20. The cornhole board of claim 19, wherein the two V-shaped elongated braces include first end portions that each extend to adjacent a respective first end member of the peripheral frame.

21. The cornhole board of claim 20, wherein the first end portions of the two V-shaped elongated braces are each positioned laterally inward and spaced apart from the frame by a respective offset, wherein the legs are positioned in the offset between the first end portions of the braces and the frame.

22. The cornhole board of claim 20, wherein the first end portions of the two V-shaped elongated braces are each positioned proximate to but not interfering with the opening in the top panel, wherein the two V-shaped elongated braces are positioned to provide spacing from the frame on one side sufficient to avoid interference with the legs and spacing from the opening on the other side to avoid interference with the toss bags passing through the opening during game play.

23. The cornhole board of claim 20, wherein the two V-shaped elongated braces are continuous along their entire lengths.

* * * * *